US006806014B2

(12) United States Patent
Schein

(10) Patent No.: US 6,806,014 B2
(45) Date of Patent: Oct. 19, 2004

(54) MONOCOMPONENT DEVELOPING ARRANGEMENT FOR ELECTROPHOTOGRAPHY

(75) Inventor: Lawrence B. Schein, San Jose, CA (US)

(73) Assignee: Aetas Technology, Inc., Hsinchu (TW)

( * ) Notice: Subject to any disclaimer, the term of this patent is extended or adjusted under 35 U.S.C. 154(b) by 0 days.

(21) Appl. No.: 10/151,197

(22) Filed: May 20, 2002

(65) Prior Publication Data

US 2003/0039912 A1 Feb. 27, 2003

Related U.S. Application Data

(63) Continuation-in-part of application No. 09/934,065, filed on Aug. 21, 2001, now Pat. No. 6,605,402.

(51) Int. Cl.[7] ..... G03G 9/00

(52) U.S. Cl. ..... 430/120; 430/108.7; 430/108.6; 399/252

(58) Field of Search ..... 430/120, 108.7, 430/108.6; 399/252

(56) References Cited

U.S. PATENT DOCUMENTS 3,720,617 A 3/1973 Chatterji et al.
5,006,898 A 4/1991 Kobayashi et al.
5,066,558 A 11/1991 Hikake et al.
5,303,010 A 4/1994 Takano et al.
5,602,631 A 2/1997 Sakaguchi
5,691,097 A 11/1997 Bortfeldt
5,752,146 A 5/1998 Sato
6,298,211 B1 10/2001 Stockman et al.
6,605,402 B2 * 8/2003 Schein et al. ..... 430/108.7

* cited by examiner

*Primary Examiner*—Mark A. Chapman
(74) *Attorney, Agent, or Firm*—Frederic M. Douglas; Neil R. Sirota

(57) ABSTRACT

A jump monocomponent development arrangement includes a dielectric photoreceptor belt having an image-bearing surface for receiving an electrostatic charge image and a development station having a supply of toner particles with a mean diameter in a range from 8 microns to 14 microns and including large and small additive particles having mean diameters in size ranges of 6 to 12 nm and 20 to 50 nm, respectively, and in amounts sufficient to provide surface coverage of the toner particles in ranges from about 5 percent to about 50 percent and about 50 percent to about 150 percent, respectively.

18 Claims, 3 Drawing Sheets

MONOCOMPONENT DEVELOPING ARRANGEMENT FOR ELECTROPHOTOGRAPHY

REFERENCE TO RELATED APPLICATION

This application is a continuation-in-part of application Ser. No. 09/934,065, filed Aug. 21, 2001 now U.S. Pat. No. 6,605,402, for Method of Using Variably Sized Coating particles in a Mono Component Developing System, the disclosure of which is incorporated by reference herein.

BACKGROUND OF THE INVENTION

The present invention relates generally to electrophotography and more particularly to monocomponent developing arrangements that facilitate efficient development of an electrostatic image and provide consistent high quality image output.

Electrophotographic imaging, or xerography is a well-known method of copying or otherwise printing documents. In general, electrophotographic imaging uses a charge-retentive, photosensitive member known as a photoreceptor having a surface that is initially charged uniformly in the dark. The charged surface is then exposed to a light image representation of a desired image to discharge specific areas of the photoreceptor surface, creating a latent electrostatic charge image. The latent electrostatic charge image is developed by applying toner in a developing unit which carries the toner from a toner container to the photoreceptor surface where it adheres to the charge image, providing a visible image. This developed image is then transferred from the photoreceptor surface to a substrate material such as paper, a transparency or the like.

A color electrophotographic image is typically produced by repeating the same process described above for each of several different image exposures using different colored toners and storing each developed image on an accumulator until all desired colors are applied and then transferring the multicolored image to the substrate.

There are several developing systems known in the art that carry the toner to a developing region to develop a latent image. In one system, known as a non-contact or jump developing system, a thin layer of toner particles is applied to a toner support member or developer roller using a leveling member such as a doctor blade. The surface of the developer roller is spaced a small distance from the latent image-bearing surface of the photoreceptor. When toner on the surface of the developer roller is moved into the developing region between the developer roller and the photoreceptor, the surface charges on the latent image areas of the photoreceptor exert electrostatic forces that draw the toner particles toward the latent image areas on the surface of the photoreceptor.

In order to reduce adhesion forces tending to retain the toner particles on the developer roller, particulate additives having a size much smaller than the size of the toner particles are often used. Such particulate additives are retained on the surface of the toner particles and limit the adhesion of the toner particles to the surface of the developer roller.

In such a jump developing system, the spacing between the adjacent surfaces of the developer roller and the photoreceptor may range between about 100 microns and about 500 microns. Due to this very small spacing it is important to assure accurate and uniform control of the thickness of the toner layer on the developer roller. In certain prior art arrangements, a leveling member such as a curved plate or flexible doctor blade extending across the width of the developer roller engages the surface of the developer roller to control the thickness of the toner layer. The Stockman et al. U.S. Pat. No. 6,298,211 discloses a jump monocomponent development arrangement.

One typical prior art doctor blade mounting arrangement is shown in the Takano et al. U.S. Pat. No. 5,303,010 in which a rigid doctor blade is mounted by clamping screws to a support plate having adjustment slots to control the spacing between the blade and the developer roller and the support plate is in turn mounted by screws to mounting members. The Kobayashi et al. U.S. Pat. No. 5,006,898 discloses a rigid doctor blade affixed to a support member by screws along with a flexible plate for spreading the toner on the support member and the Sakaguchi U.S. Pat. No. 5,602,631 discloses a toner leveling member in the form of a curved plate which confirms the toner layer to a desired thickness. The Sato U.S. Pat. No. 5,752,146 shows a flexible doctor blade for regulating the thickness of a layer of toner particles having a size in a range from $6\mu$ to $12\mu$ which are coated with particles of an additive such as silica having a size in a range from 10 nm to 30 nm to limit adhesion and improve toner flow and other toner characteristics.

The United States patents to Chatterji et al., U.S. Pat. No. 3,720,617, Hikaki No. 5,066,588, and Bertfeldt No. 5,691,097 also disclose addition of silica particles such as fused silica particles to improve toner properties.

Typically, a fixed leveling member or a flexible doctor blade that is used as a leveling member in a jump development system applies pressure to the toner in order to spread a uniform layer on the surface of the developer roller. Unless the pressure applied to the toner particles by the leveling member is carefully controlled, however, small additive particles such as silica or other additive materials can be forced into the surface of the toner particles, altering their characteristics and reducing the effectiveness of the toner.

SUMMARY OF THE INVENTION

Accordingly, it is an object of the present invention to provide a monocomponent developing arrangement for electrophotography which overcomes disadvantages of the prior art.

Another object of the invention is to provide a monocomponent developing arrangement for electrophotography which has improved characteristics and minimizes costs.

These and other objects of the invention are achieved by providing a monocomponent developing arrangement in which the toner has particulate additives of two different size ranges and the ratio of concentrations of the different size range additives optimizes surface coverage of the additives on the toner particles to achieve improved characteristics.

In a preferred embodiment of the invention a developing arrangement for electrophotography utilizes a monocomponent developer with particulate additives of two different size ranges along with a developer roller which carries the toner to a development region where toner particles are selectively attracted to an electrostatic charge image on a photoreceptor surface spaced from the developer roller so as to cause jump development of the charge image and a leveling member such as a doctor blade spreads the toner particles on the surface of the developer roller prior to entering the development region to provide substantially uniform coverage of the surface of the development roller with toner particles bearing additive particles of two different size ranges.

According to one preferred embodiment the toner particles have a mean diameter in a range from about 8 microns to about 14 microns and preferably about 12 microns, and are coated with large additive particles having a mean diameter in a range from about 20 nm to about 50 nm, and preferably about 40 nm, and small additive particles having a mean diameter in a range from about 6 nm to about 12 nm, and preferably about 10 nm, with the large additive particles being supplied in an amount sufficient to produce surface coverage of the toner particles in a range from about 5 percent to about 50 percent and the small additive particles being present in an amount sufficient to produce surface coverage of the toner particles in a range from about 50 percent to about 150 percent.

With this arrangement, it has been found that the toner particle characteristics are not changed significantly by pressure applied by a leveling member such as a doctor blade used to control the height of the layer of toner particles applied to the developer roller and avoid degradation of coatings applied to the toner particles such as coatings of charge control materials are avoided even with significant variations in pressure applied by the leveling member. In this regard, it is believed that the smaller area ratio of large additive particles to small additive particles on the surface of the toner particles is important to inhibit or preclude embedding of the small additive particles into the body of the toner particles even with significant variations in pressure applied by the leveling member.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
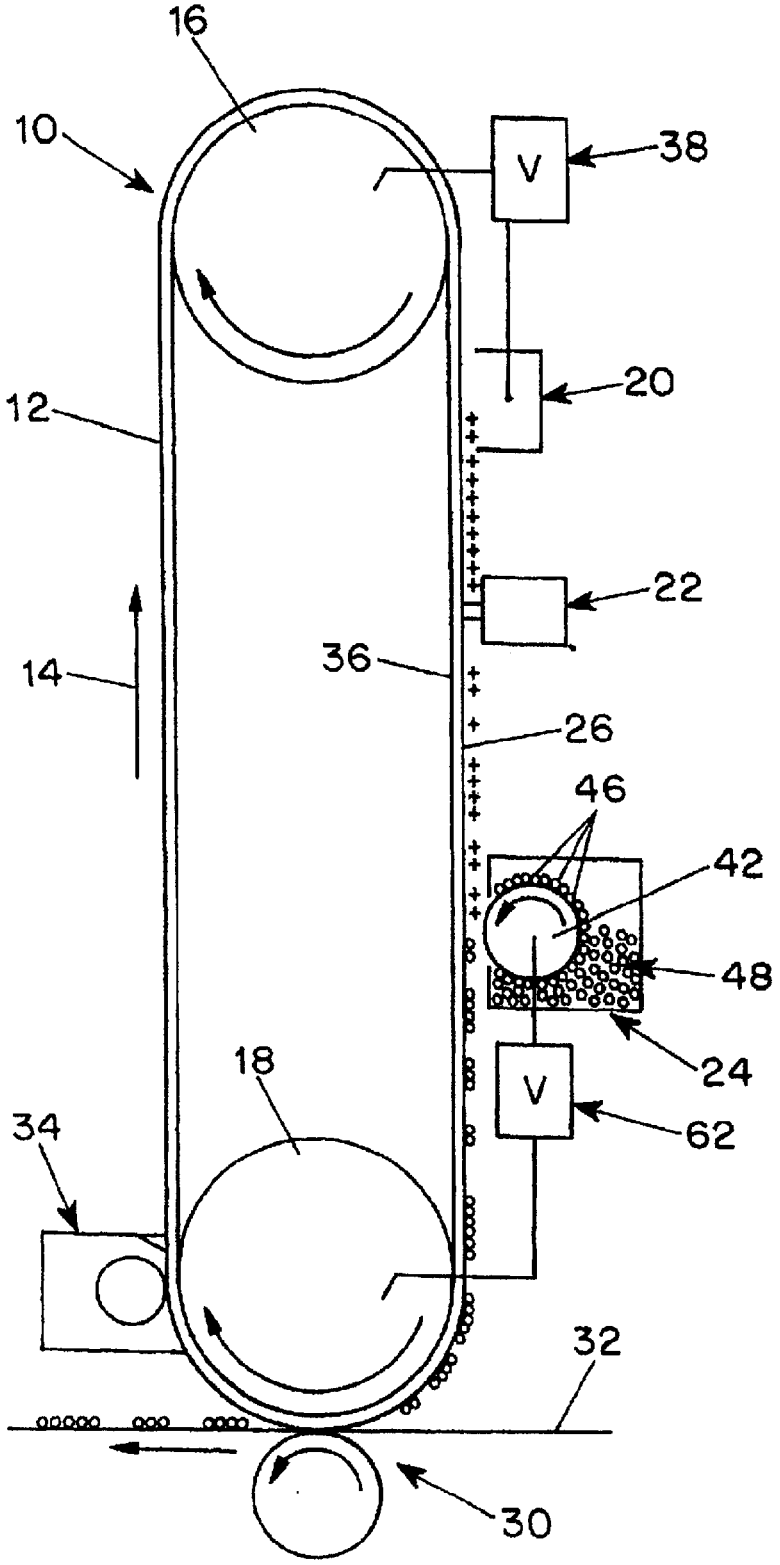
FIG. 1 is a schematic diagram illustrating a representative embodiment of an electrophotographic imaging system utilizing a jump monocomponent development arrangement.

In the representative embodiment of the invention shown in FIGS. 1 and 2, an electrophotographic imaging system 10 includes a photoreceptor member 12 in the form of a continuous belt which is conveyed in an endless loop path in the direction indicated by the arrow 14 by two drive rolls 16 and 18 past a charging station 20, an exposure station 22, and a developing station 24 in succession to produce a toner image on the outer surface 26 of the belt which is subsequently transferred at an image transfer station 30 to a substrate 32 such as a sheet of paper. A cleaning station 34 following the transfer station 30 removes any excess toner from the surface 26 of the photoreceptor 12. It will be understood that several successive groups of charging, exposure, and development stations arranged to produce different color images may be provided in the path of motion of the photoreceptor so as to produce a multicolor image which is subsequently transferred to the substrate 32.

The inner surface 36 of the photoreceptor 12 has a conductive layer which is coupled through the drive roll 36 to a potential source 38 having its positive terminal coupled to the charging unit 20 so as to control the potential level of the charge applied by the charging unit 20 to the outer surface 26 of the photoreceptor as it passes adjacent to the charging unit 20. The potential level of the charges should be sufficient to assure a contrast potential of an electrostatic charge image on the surface, i.e., the difference between the image potential and the background potential, in the range from about 1000 volts to about 2000 volts. The uniformly charged outer surface 26 is then subjected to image illumination at the exposure station 22 which may, for example, contain an LED array, to dissipate charges in selected regions of the outer surface 26 of the photoreceptor, thereby producing an electrostatic charge image on that surface. The electrostatic charge image is then moved past the developing station 24 in which a rotating developer roller 42 electrostatically attracts insulating toner particles 46 from a toner supply 48 and carries them past a flexible doctor blade 50 which controls the thickness of the resulting layer 52 of toner particles 46 on the surface of the developer roller 42 as it moves towards the adjacent surface 26 of the photoreceptor 12.

Figure 2:
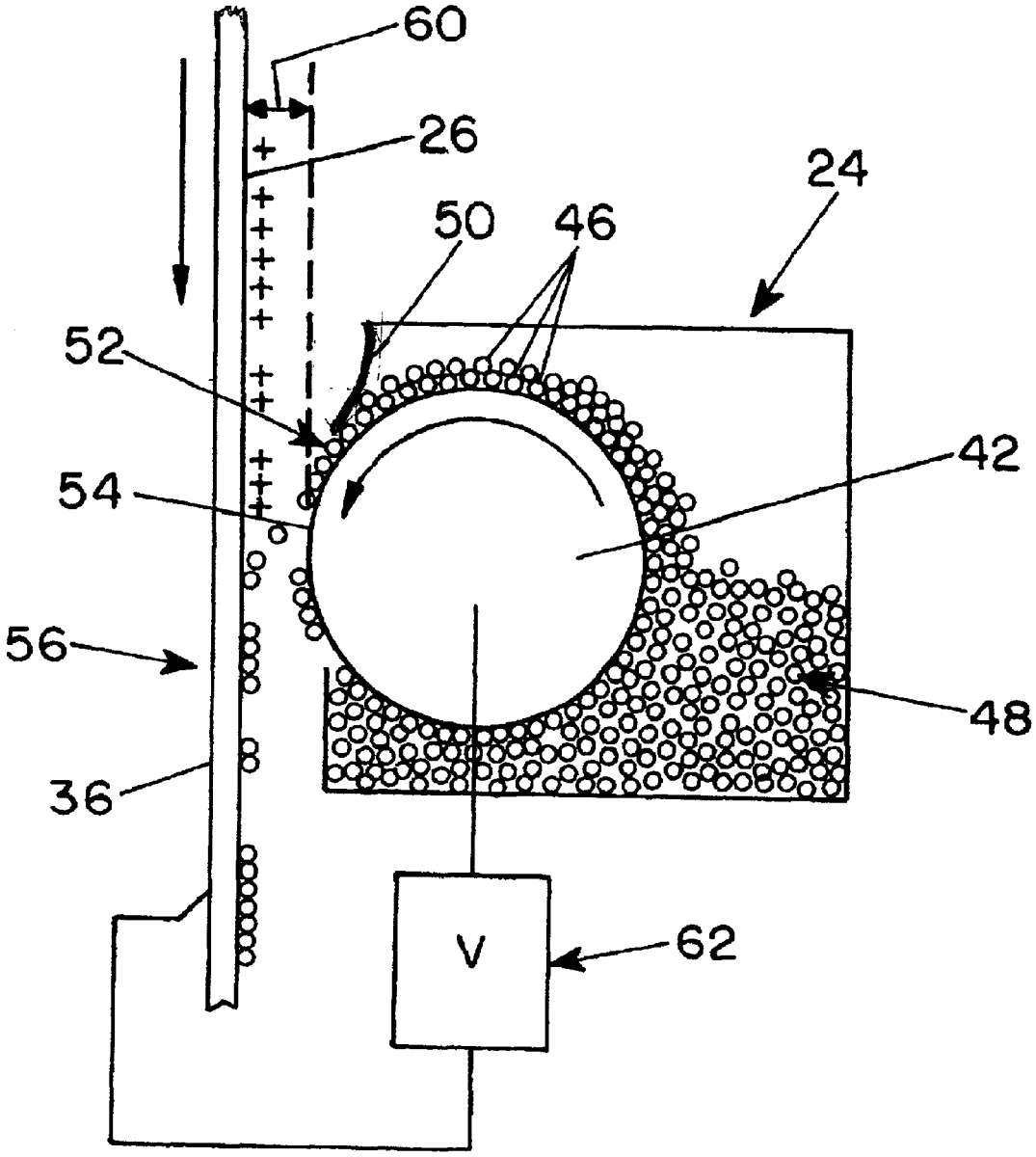
FIG. 2 is an enlarged schematic diagram showing the jump monocomponent development in the system shown in FIG. 1.

At the developing station 24, as best seen in the enlarged view of FIG. 2, individual toner particles 46, which are retained by electrostatic adhesion on the surface 54 of the developer roller 42, are carried to a development location 56 at which the developer roller surface 54 is spaced from the imaging surface 40 of the photoreceptor belt by a predetermined gap 60, which may be on the order of 100 to 500 microns, for example, and preferably about 200 microns to about 300 microns. The toner particles 46 have an average diameter in the range from about one micron to about 20 microns, preferably in the range from about 8 microns to about 14 microns and desirably about 12 microns. In order to induce toner particles 46 to jump across the gap selectively toward the charged portions of an electrostatic charge image on the surface 26 of the photoreceptor while avoiding any transfer of toner particles to those parts of that surface which do not contain the electrostatic charge image, a potential source 62 applies a bias voltage of about 500 volts to about 1500 volts, and preferably about 750 volts to about 1000 volts, between the developer roller 42 and the conductive surface 36 on the opposite side of the photoreceptor belt 12. To facilitate transfer of toner particles, the surface of the developer roller 42 should have a roughness average (RA), i.e., the average peak height of roughness peaks, of no more than about 0.15$\mu$.

Although positive symbols are used to indicate the charged portions of the image-bearing surface 26 of the photoreceptor in the schematic illustrations shown in the drawings, it will be understood that a negative charge image can also be developed in accordance with the invention by reversing the polarities of the potential sources 38 and 62.

In order to limit the adhesive forces retaining the toner particles 46 on the surface of the developer roller 42 so as to facilitate release and transfer of the toner particles to the charged image areas, particulate additives are included in the toner supply 48. These particulate additives, which adhere to the surface of the toner particles, may be, for example, particles of silica, titanium dioxide, polymer microspheres, polymer beads, cerium oxide, zinc stearate, alumina or the like. In a preferred development arrangement, the additive particles are silica particles, desirably fused silica particles.

In accordance with the invention the particulate additives are provided in two different particle size ranges including small size particulate additive particles in a proportion sufficient to cover large portions of the surfaces of the toner particles and larger size particulate additive particles in a proportion which is sufficient to cover a portion of the surface of the toner particles which is substantially smaller but is capable of shielding most of small particulate additive particles from pressure applied by a leveling member such as a doctor blade which would otherwise tend to embed the small additive particles into the toner particles.

Figure 3:
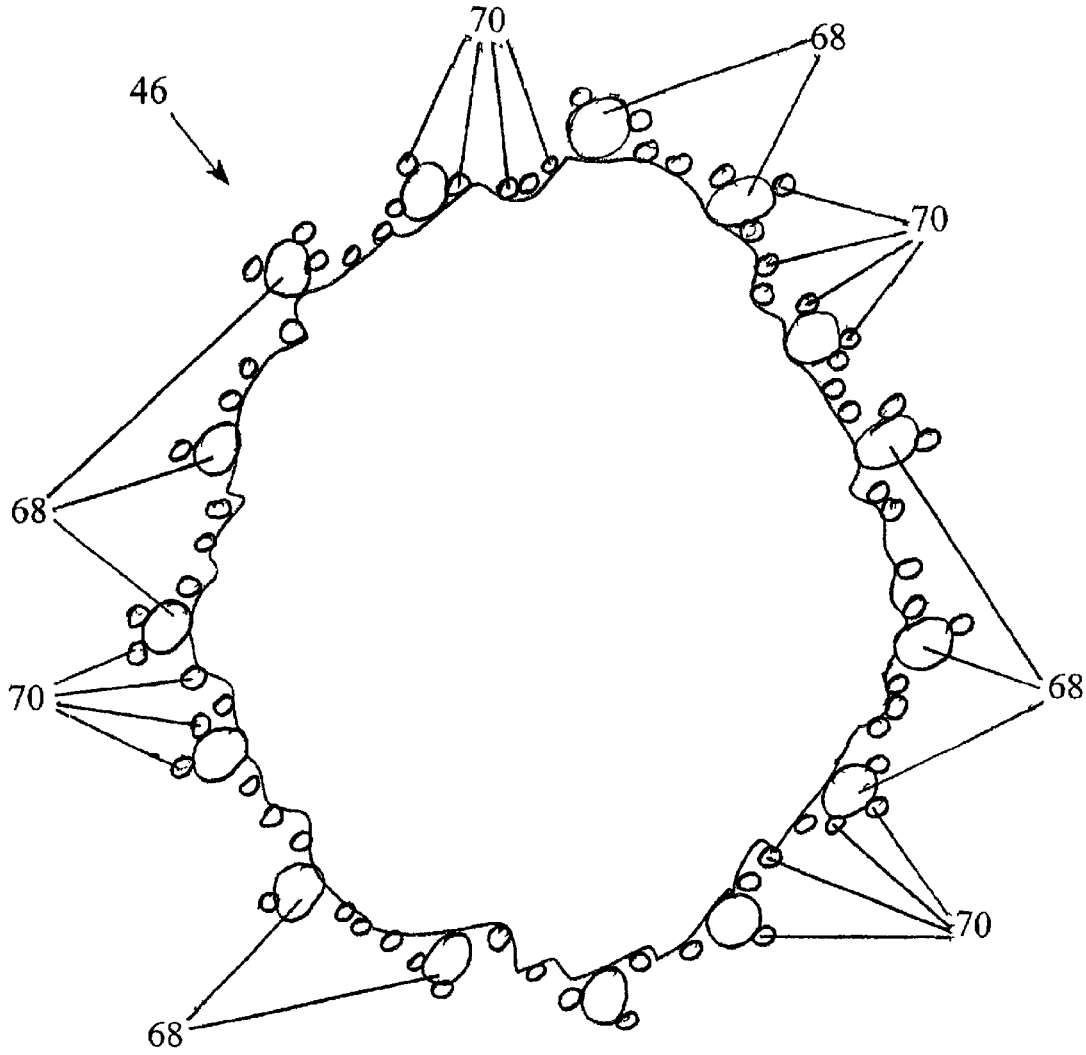
FIG. 3 is a greatly magnified view showing a representative toner particle provided with additive particles of two different size ranges in accordance with the invention.

FIG. 3 is a greatly magnified view showing one of the toner particles 46 having large particulate additive particles 68 and small particulate additive particles 70 adhering to the toner particle surface. Preferably the large particulate additive particles 68 have a mean diameter in a range from about 20 nm to 50 nm, desirably about 40 nm, and are present in sufficient quantity to cover the surface of each toner particle by about 5 percent to about 50 percent, and desirably about 15 percent, and the small additive particles 70 have a mean diameter in a range from about 6 nm to about 12 nm, desirably about 10 nm, and are present in an amount sufficient to provide surface coverage for the toner particles in a range from about 50 percent to about 150 percent of the toner surface.

A toner may be prepared with the required calculated surface area coverage of large and small additive particles 68 and 70 by incorporation of a specific weight percent of each of the large and small additive particles by taking into account the mean diameter of the toner particles, the specific gravity of the toner material and mean diameters and densities of each of the large and small additive particles. For example, for a 12$\mu$ mean diameter toner with specific gravity of 1.1 g/cm$^3$ combined with large additive particles having a mean diameter of 40 nm and a specific gravity of 2.2 g/cm$^3$ and small additive particles having a mean diameter of 10 nm and specific gravity of 2.2 g/cm$^3$, the surface area coverage of the large additive particles of 5 to 50 percent corresponds to a concentration by weight of 0.16 percent to 1.6 percent of the toner particles and the surface area coverage of the small additive particles of 50 to 150 percent corresponds to a concentration by weight of 0.45 percent to 1.35 percent of the toner particles.

With this developing arrangement, improved efficiency and effectiveness of monocomponent developers is provided without requiring precise control of the pressure applied by a leveling member to the toner layer on the developer roller since the large additive particles tend to shield the small additive particles for the surface of the toner particles from the pressure applied by the leveling member, preventing the small additive particles from being embedded into the surface of the toner particles. This, in turn, maintains the forces causing the toner particles to adhere to the developer roller at a low level, permitting effective transfer of the toner particles to the charged image areas while avoiding transfer to uncharged areas of the photoreceptor. As a result, the cost of electrophotographic arrangements utilizing monocomponent developers is reduced without reducing the quality of image reproduction provided by such arrangements.

Although the invention has been described herein with reference to specific embodiments, many modifications and variations therein will readily occur to those skilled in the art. Accordingly, all such variations and modifications are included within the intended scope of the invention.

I claim:

1. A jump monocomponent development arrangement comprising:

a photoreceptor member having an image-receiving surface on one side to convey an electrostatic charge image adjacent to the development station;

a development station including a developer roller having a toner-carrying surface separated by a development gap from the image-receiving surface of the photoreceptor member to apply toner particles to an electrostatic charge image to produce a toner image thereon by jump development;

a toner supply for supplying toner particles to the surface of the developer roller together with large additive particles having a mean diameter in the range from about 20 nm to about 50 nm and being present in an amount sufficient to provide surface coverage of the toner particles in a range from about 5 percent to about 50 percent and small additive particles having a mean diameter in a range from about 6 nm to about 12 nm and being present in an amount sufficient to provide surface coverage of the toner particles in a range from about 50 percent to about 150 percent; and a leveling member for spreading the toner particles in a thin layer on the surface on the developer roller.

2. A jump monocomponent development arrangement according to claim 1 wherein the additive particles comprise particles selected from the group consisting of silica, titanium dioxide, polymer microspheres, polymer beads, cerium oxide, zinc stearate and aluminma.

3. A jump monocomponent development arrangement according to claim 1 wherein the large and small additive particles comprise fused silica particles.

4. A jump monocomponent development arrangement according to claim 1 wherein the toner particles have a mean diameter in the range from about 8 microns to about 14 microns.

5. A jump monocomponent development arrangement according to claim 4 wherein the toner particles have a mean diameter of about 12 microns.

6. A jump monocomponent development arrangement according to claim 1 wherein the large additive particles have a mean diameter of about 40 nm.

7. A jump monocomponent development arrangement according to claim 1 wherein the small additive particles have a mean diameter of about 10 nm.

8. A jump monocomponent development arrangement according to claim 1 wherein the toner supply at the development station includes toner particles of one selected color and including a plurality of further development stations containing each toner particles of a different selected color.

9. An electrophotographic imaging system including a charging station for charging a surface of a photoreceptor member, an exposure station for exposing an image-receiving surface of the photoreceptor member to an image to produce an electrostatic charge image, and a jump monocomponent development arrangement according to claim 1.

10. An electrophotographic imaging system according to claim 9 including a transfer station for transferring a toner image from the image-receiving surface of the photoreceptor member to a substrate.

11. A method of effecting jump development in an electrophotographic system comprising:

providing a toner supply comprising a mixture of toner particles and large and small additive particles wherein the large additive particles have a mean diameter in a range from about 20 nm to about 50 nm and are present in an amount sufficient to provide surface coverage of the toner particles in a range from about 5 percent to about 50 percent and the small additive particles have a mean diameter in a range from about 6 nm to about 12 nm and are present in an amount sufficient to provide surface coverage of the toner particles in a range from about 58 percent to about 150 percent;

applying the toner particles with the additive particles to a developer roller;

leveling the toner particles on the surface of the developer roller to provide a thin layer of toner particles; and selectively transferring toner particles from the surface of the developer roller to charged areas in a charge image on the surface of an adjacent member by jump development to produce a toner image.

12. A method according to claim 11 wherein the additive particles comprise particles selected from the group consisting of silica, titanium dioxide, polymer microspheres, polymer beads, cerium oxide, zinc stearate and aluminma.

13. A method according to claim 11 wherein the large and small additive particles comprise fused silica particles.

14. A method according to claim 11 wherein the toner particles have a mean diameter in the range from about 8 microns to about 14 microns.

15. A method according to claim 14 wherein the toner particles have a mean diameter of about 12 microns.

16. A method according to claim 11 wherein the large additive particles have a mean diameter of about 40 nm.

17. A method according to claim 11 wherein the small additive particles have a mean diameter of about 10 nm.

18. A method according to claim 11 wherein the toner particles have a selected color and including the steps of providing a plurality of further toner supplies with large and small additive particles in which each of the toner supplies has toner particles of a different selected color.

* * * * *